US007897558B1

(12) United States Patent
Arafat

(10) Patent No.: US 7,897,558 B1
(45) Date of Patent: Mar. 1, 2011

(54) SILOXANE SOLVENT COMPOSITIONS

(75) Inventor: El Sayed Arafat, Leonardtown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/639,476

(22) Filed: Dec. 16, 2009

(51) Int. Cl.
*C11D 9/36* (2006.01)

(52) U.S. Cl. ..... 510/466; 510/245

(58) Field of Classification Search ..... 510/245, 510/466
See application file for complete search history.

(56) References Cited

U.S. PATENT DOCUMENTS

| | | | | |
|---|---|---|---|---|
| 5,942,007 | A * | 8/1999 | Berndt et al. | 8/142 |
| 7,569,652 | B2 | 8/2009 | Kennedy et al. | |
| 7,576,170 | B2 | 8/2009 | Perry et al. | |
| 7,579,495 | B2 | 8/2009 | Perry et al. | |

* cited by examiner

*Primary Examiner*—Brian P Mruk
(74) *Attorney, Agent, or Firm*—Mark O. Glut; Mark D. Kelly

(57) ABSTRACT

The present invention relates to non-volatile organic compositions having a VOC of about zero, a flash point above 140° F., and a vapor pressure of less than seven millimeters of mercury (7 mm Hg). The non-volatile organic compositions comprise an alkylated cyclicsiloxane having 5 to 8 repeating siloxane units, an alkylated cyclicsiloxane having 3 or 4 repeating siloxane units, and at least one glycol alkyl ether.

20 Claims, No Drawings

SILOXANE SOLVENT COMPOSITIONS

ORIGIN OF INVENTION

The invention described herein was made by employees of the United States Government and may be manufactured and used by or for the Government for governmental purposes without the payment of any royalties thereon or therefor.

FIELD OF THE INVENTION

This invention relates to a unique combination of two or more alkylated cyclic siloxanes and glycol ethers as solvents characterized as low-volatile organic or non-volatile organic compositions with flash points above 140° F., and vapor pressures of less than seven millimeters of mercury (7 mm Hg.).

BACKGROUND OF THE INVENTION

Solvent cleaners are known for their excellent cleaning ability, quick drying, metal compatibility, and low surface tension to facilitate penetration. Unfortunately, some solvents are known also for the air pollution they cause (as volatile organic compounds or VOC), toxicity, flammability, and incompatibility with plastics.

The use of volatile organic compounds (VOC) solvents has been discouraged due to their deleterious effect on the environment. Regulations have been promulgated to accelerate the phase-out of environmentally destructive solvents.

The Environmental Protection Agency ("EPA") promulgates rules and regulations regarding environmental concerns such as VOCs. EPA has defined VOC's to include volatile compounds of carbon which promote atmospheric photochemical reactivity. Thus, there is a need to reduce the use of conventional VOC solvents and it is apparent that there is a need for solvents which have little or no VOC content.

The old specification P-D-680 solvent, commonly called Stoddard solvent or mineral spirits, contains petroleum fractions that are complex mixtures of aliphatic hydrocarbons, but may contain some aromatics and olefinics. P-D-680 contains hazardous air pollutants (HAP's) and VOC's, and causes health and environmental concerns. The revision to MIL-PRF-680 eliminated the HAP's, but MIL-PRF-680 still covers a petroleum-based solvent containing the same amount of VOC's as P-D-680. Since P-D-680 was first written, these solvents have been specified for general cleaning to remove oil and grease from aircraft and engine components and from ground support equipment.

There are several alternatives to the P-D-680/MIL-PRF-680 solvents: water-based, semi-aqueous, and solvent-based cleaners. Water-based cleaners contain detergents to remove grease and oil and may be used hot and/or with various forms of agitation (spray or ultrasonic). Disadvantages include flash rusting, embrittlement of high strength steel and poor cleaning efficiency. Semi-aqueous cleaning processes incorporate not only detergents, but also solvents to improve effectiveness. Some products contain solvents emulsified in water while others contain water-rinsable solvents. A significant disadvantage to semi-aqueous cleaners is their susceptibility to separation. Solvent-based cleaners, however, continue to be used in effective, low cost cleaning processes. In order to retain the capability of solvent cleaning, a new type of solvent is needed to meet the HAP and VOC requirements.

Under Title III of the 1990 Clean Air Act (CAA) amendments, the U.S. Environmental Protection Agency (EPA) has established emissions standards for categories and sub-categories of sources that emit or have the potential to emit listed HAPs. In addition, under the proposed rule, MIL-PRF-680 will no longer be allowed in solvent degreasing operations in the SCAQMD. If a substitute material or process is not authorized, the Aircraft Intermediate Maintenance Detachment (AIMD) at Lemoore and other maintenance facilities will not be able to perform specific maintenance requirements in accordance with NAVAIR technical manuals. Since MIL-PRF-680 is the only material authorized by the applicable maintenance manuals to clean flight critical parts, an approved alternative for MIL-PRF-680 is necessary to meet the new environmental regulations.

To meet the new regulations, NAVAIR's Aircraft Materials Laboratory at Patuxent River, Md., recently tested several commercial products. As a result, a new specification MIL-PRF-32295 entitled "Cleaner, Non-Aqueous, Low-VOC, HAP-Free solvents," was developed to provide environmentally friendly cleaners to the Department of Defense (DoD) services. The new specification requires that a solvent must be free of HAPs, must contain no more than 25 grams per liter of VOC's, must be effective on grease and oil, must not contain ozone-depleting substances (non-ODS), must be non-toxic, must be compatible with metals and non-metals, and must be safe to use. In addition, the Aerospace National Emission Standards for Hazardous Air Pollutants (NESHAP) states that immersion-cleaning solvents must have vapor pressures less than seven millimeters of mercury (7 mm Hg.), and wipe cleaning solvents must have vapor pressures less than 45 mm Hg. MIL-PRF-32295 classifies low vapor pressure solvents (less than 7 mm Hg) as Type I and moderate vapor pressure solvents (less than 45 mm Hg) as Type II. This invention will meet the requirements of MIL-PRF-32295 Type II specification. Products of this invention qualify to be used to clean weapon systems across DoD maintenance facilities as an alternative to MIL-PRF-680.

SUMMARY OF THE INVENTION

The present invention relates to solvent compositions characterized as low-volatile organic or non-volatile organic solvents. The non-volatile (non-VOC) organic solvents consist essentially of a unique combination of at least one or more alkylated cyclicsiloxanes having from 5 to 8 repeating siloxane units wherein said alkyl or alkylated substituents have from 1 to 6 carbon atoms, and at least one alkylated cyclicsiloxane having 3 or 4 repeating siloxane units wherein said alkyl or alkylated substituents have 1 to 4 carbon atoms, and at least one glycol alkyl ether. These non-volatile organic cyclicsiloxane solvents are further characterized as having flash points above 140° F. and vapor pressures of less than seven millimeters of mercury (7 mm Hg.).

DETAILED DESCRIPTION OF THE INVENTION

The present invention relates to organic compositions consisting essentially of low-volatile (low-VOC) or non-volatile (non-VOC) compounds. These organic compositions are further characterized as having flash points above 140° F., and have vapor pressures of less than seven millimeters of mercury (7 mm Hg.).

The organic compositions are particularly useful as non-volatile (non-VOC) solvents and consist essentially of about 50 to 70 and more particularly 55 to 65 parts by weight of at least one alkylated cyclicsiloxane having from 5 to 8 repeating siloxane units wherein said alkylation or alkyl substituents have from 1 to 6 linear or branched carbon atoms including, for example, methyl, ethyl, propyl, isopropyl, butyl, isobutyl, pentyl, hexyl, and from about 20 to 40 and more particularly 25 to 35 parts by weight of at least one alkylated cyclicsiloxane having 3 or 4 repeating siloxane units wherein said alkylation or alkyl substituents have from 1 to 4 linear or branched carbon atoms including, for example, methyl, ethyl, propyl, isopropyl, butyl, and isobutyl, and from about 5 to 15 and more particularly 8 to 12 parts by weight of at least one glycol alkyl ether wherein said alkyl substituent has 4 to 8 branched or linear carbon atoms. The alkylation of the cyclicsiloxanes can be derived from alkyl compounds that are branched or linear and are either all the same or different alkyl compounds. It is important that the alkyl groups of the glycol alkyl ethers have at least four carbon atoms derived from the same or different alkyl compounds.

Typical examples of the cyclicsiloxanes having 5 to 8 repeating siloxane units, and the cyclicsiloxanes having 3 or 4 siloxane units include, for example, tetramethylcyclotetrasiloxane, 1,3,5,7-tetraethylcyclotetrasiloxane, 1,3,5,7,9-pentamethylcyclopentasiloxane, 1,3,5,7,9-pentaethylcyclopentasiloxane octamethyl cyclotetrasiloxane, decamethyl pentacyclosiloxane. Particularly suitable is a mixture or blend of octamethylcyclotetrasiloxane and decamethylcyclopentasiloxane and a diethylene glycol monoalkyl ether. The glycol alkyl ethers particularly include the monoalkyl ethers of diethylene glycol, triethylene glycol, tetraethylene glycol, and the lower molecular weight polyethylene glycol alkyl ethers wherein the alkyl group must have at least four (4) branched or linear carbon atoms.

The following are specific examples illustrating the cyclicsiloxane glycol ether compositions of this invention.

Example I

| | Parts by Weight |
|---|---|
| Decamethylcyclopentasiloxane | 57-62 |
| Octamethylcyclotetrasiloxane | 28-32 |
| Diethylene glycol monobutyl ether | 8-12 |

Example II

| | Parts by Weight |
|---|---|
| Decaalkylcyclopentasiloxane | 55-65 |
| Octaethylcyclotetrasiloxane | 25-35 |
| Trithylene glycol alkyl ether | 8-12 |

Example III

| | Parts by Weight |
|---|---|
| Decaethylcyclopentasiloxane | 50-70 |
| Octamethylcyclotetrasiloxane | 20-40 |
| Diethylene glycol monoalkyl ether | 5-15 |

Properties of the Cyclicsiloxane Compositions of the Invention

I. Cleaning Efficiency

The cleaning efficiency test for the cyclosiloxane solvents (Navsolve cleaner) of this invention was conducted in accordance with MIL-PRF-32295 specification (test Method 4.5.9) as described below.

Preparation of test specimens. Stainless steel coupons 1 by 2 by 0.05 inches (25 by 50 by 1.3 mm) shall be polished with 240 grit aluminum oxide abrasive paper or cloth and solvent wiped with isopropyl alcohol. Coupons shall be weighed (weight=W1), coated on one side with 20-25 mg of soil, then reweighed (weight=W2). Soils to be tested were as follows:

a. MIL-G-21164
b. MIL-PRF-83282
c. MIL-PRF-10924

Test procedure. Fresh solvent was used for each soil tested. Each test coupon was cyclically immersed and withdrawn from a 150-ml beaker containing 100 ml of the cleaner at a rate of 20 cycles per minute for 5 minutes. Each coupon shall then be dried for 10 minutes at 140±4° F. (60±2° C.), cooled to room temperature, and reweighed (weight=W3). Cleaning efficiency for the cleaner was calculated as follows for each coupon:

$$\%\ \text{Cleaning efficiency}=(W2-W3)/(W2-W1)\times 100$$

The test result for each soil shall be the average of three coupon cleaning efficiencies.

| Soil/Product | Control (MIL-PRF-680) | Navsolve |
|---|---|---|
| MIL-G-21164 | 68% | 74% |
| MIL-PRF-10924 | 86% | 94% |
| MIL-PRF-83282 | 97% | 97% |

II. Volatile Organic Compounds (VOC) Analysis

The VOC content for the cyclosiloxane solvents of this inventin (Navsolve cleaner) was measured in accordance with MIL-PRF-32295 Specification (SCAQMD Method 313-06). The VOC analysis for the cyclosiloxane solvents (Navsolve cleaner) was found as 4.0 g/l; the VOC content for MIL-PRF-680 is more than 750 g/l.

III. Total Immersion Corrosion Test

The total immersion corrosion test for the cyclosiloxane solvents (Navsolve cleaner) was conducted in accordance with the requirements of MIL-PRF-32295 specification (ASTM F483) and gave the following results:

| Metal/Product | MIL-PRF-32295 mg/cm2/day | Navsolve mg/cm2/day |
|---|---|---|
| Aluminum (SAE-AMS-QQ-A-250/4 | 0.04 | 0.01 |
| Aluminum (SAE-AMS-QQ-A-250/12) | 0.04 | 0.01 |
| Titanium (SAE-AMS4911) | 0.04 | 0.01 |
| Magnesium (SAE-AMS-M-3171) | 0.20 | 0.01 |
| Steel (SAE-AMS5040) | 0.04 | 0.01 |

IV. Sandwich Corrosion Test

The sandwich corrosion test for the cyclosiloxane solvents (Navsolve cleaner) was conducted in accordance with MIL-PRF-32295 specification requirements (ASTM F1110); the product met the requirements successfully. The following aluminum alloys were used in conducting the sandwich corrosion test:

Aluminum SAE 250/4

Aluminum SAE 250/5

Aluminum SAE 250/12

Aluminum SAE 250/13

V. Flash Point

The flash point of flammable liquid is the lowest temperature at which it can form an ignitable mixture in air. The flash point for the cyclosiloxane solvents (Navsolve cleaner) was measured in accordance with MIL-PRF-32295 specification (ASTM D-56) and found as 141° F. To avoid the flammability problems, the flash point for the solvent must be 140° F. or higher. The flash point property is essential for solvent cleaner selection to ensure worker safety and health protection.

VI. Hydrogen Embrittlement Test

The hydrogen embrittlement test was conducted in accordance with MIL-PRF-32295 specification (ASTM F519); using cadmium-plated AIS14340, type 1a specimens. Each specimen was stressed by applying a load equivalent to 45 percent of notch fracture strength. The notch was immersed in the cleaner for the duration of the test (150 hours). The cyclosiloxane solvent of this invention (Navsolve cleaner) met the requirements successfully.

Advantages and New Features

To meet the new environmental regulations, it is essential to identify and validate effective, safe, and environmentally friendly products for cleaning applications. The advantages of the cyclosiloxane solvent (Navsolve cleaner) are listed below:

Low VOC contents (4.0 g/L)

Free of Hazard Air Pollution (HAP-free)

Acceptable flash point (140° F.-145° F.)

Compatible with metals and non-metals

Non-corrosive

Non-Toxic

TABLE 1

Properties and Test Methods

| PROPERTY | REQUIREMENT | TEST METHOD | RESULT |
|---|---|---|---|
| VOC content, grams/liter (maximum) | 25 | SCAQMD Method 313 | NOT TESTED |
| Apparent specific gravity, 80/80 F. | No change from qualification sample | ASTM D891 | 0.963 Informational |
| Vapor pressure, mm Hg at 20° C. (maximum) | Type I 7 Type II 45 | ASTM D2879 | 2 mm Hg Conforms (Types I & II) |
| Flash point, ° F. (° C.) (minimum) | 140 (80) | ASTM D56 | No flash to 141° F. Conforms |
| Nonvolatile residue, mg/100 ml, (maximum) | 5 | ASTM D1353 | 3 mg/100 mls Conforms |
| Acidity | 0.02* | ASTM D1613 | *Acidity as Acetic Acid, wgt. % = <0.01 Conforms |

TABLE 1-continued

Properties and Test Methods

| PROPERTY | REQUIREMENT | TEST METHOD | RESULT |
|---|---|---|---|
| Odor | No-offensive, low intensity, non-residual | ASTM D1296 and 4.5 10 | Non-offensive, low intensity, non-residual Conforms |
| Miscibility with water | Immiscible | 4.5.1 | Immiscible Conforms |
| Drying time, minutes, (maximum) | 50 | 4.5.2 | Less than 50 min. Conforms |
| Low temperature stability | No freezing and no separation | 4.5.3 | No freezing/ separation Conforms |
| Sandwich corrosion (maximum) | Rating of 1 | ASTM F1110 | Ratings = 1, maximum Conforms |
| Immersion corrosion, mg/cm$^2$/day (maximum | | ASTM F483 and 4.5.4 | QQ-A-250/ 4: 0.01 QQ-A-250/ *12: 0.01 |
| Aluminum, Titanium, Steel | 0.04 | | AMS-4011: 0.01 |
| Magnesium | 0.20 | | AMS-5040: 0.01 AMS-4377: 0.01 Conforms |
| Cadmium corrosion test mg/cm$^2$/day (maximum) | 0.20 | ASTM F1111 | 0.01 mg/ cm$^2$/day Conforms |
| Copper corrosion rating (maximum) | 1b | ASTM D130 and 4.5.5 | 1a Conforms |
| Effect on unpainted surfaces | No streaks or stains | ASTM F485 | Conforms |
| Hydrogen embrittlement | No failures in less than 150 hours when specimens are loaded to 45 percent of fracture strength and immersed in cleaner | ASTM F519 and 4.5.6 | Type 1a, cadmium plated: No failures within 150 hours Conforms |
| Titanium stress corrosion (examined with 500X magnification) | No cracking | ASTM F945 Method A | AMS 4911/ AMS 4918 No cracking Conforms |
| Effect on painted surfaces | No streaks, fading, blisters, or discoloration No softening >1 pencil hardness | ASTM F502 | No effect Conforms |
| Effect on plastics | | ASTM F484 | |
| Acrylic, Type A & C | No crazing | | Type A: No crazing Conforms |
| Polycarbonate AMS-P-83310 | No crazing after 2 hrs at 2000 psi | | Type C: No crazing Conforms 83310: No crazing Conforms |
| Effect on polyimide wire | No more insulation cracking than with distilled water and no subsequent dielectric breakdown or leakage | 4.5.7 | No dielectric breakdown or leakage. Conforms |

TABLE 1-continued

Properties and Test Methods

| PROPERTY | REQUIREMENT | | TEST METHOD | RESULT |
|---|---|---|---|---|
| Effect on sealant | No change in Shore A hardness greater than ±5 units | | 4.5.8 | No change in Shore A hardness greater than ±5 units |
| Cleaning efficiency on MIL-PRF-83282 soil | Type I No less than 85% | Type II No less than 95% | 4.5.9 | Conforms MIL-PRF-83282: 97% MIL-G-21164: 74% MIL-PRF-10924; 94% |
| MIL-G-21164 soil | No less than 60% | No less than 70% | | Conforms (Type I & Type II) |
| MIL-PRF-10924 grease | No less than 85% | No less than 85% | | |

TABLE II

MIL-PRF-32295A Properties and Test Methods

| PROPERTY | REQUIREMENT | | | TEST METHOD |
|---|---|---|---|---|
| VOC content, grams/liter (maximum) | Type I 25 | Type II 25 | Type III Exempt | SCAQMD Method 313 |
| Apparent specific gravity, 60/60° F. | No change from qualification sample | | | ASTM D891 |
| Vapor pressure, mm Hg at 20° C. (maximum) | Type I 7 | Type II 45 | Type III No limit | ASTM D2879 |
| Flash point, ° F. (° C.) (minimum) | 140 (60) | | | ASTM D56 |
| Nonvolatile residue, mg/100 ml, (maximum) | 5 | | | ASTM D1353 |
| Acidity | 0.02 | | | ASTM D1613 |
| Odor | Non-offensive, low intensity, non-residual | | | ASTM D1296 and 4.5.10 |
| Miscibility with water | Immiscible | | | 4.5.1 |
| Drying time, minutes (maximum) | 50 | | | 4.5.2 |
| Low temperature stability | No freezing and no separation | | | 4.5.3 |
| Sandwich corrosion (maximum) | Rating of 1 | | | ASTM F1110 |
| Immersion corrosion, mg/cm$^2$/day (maximum) | | | | ASTM F483 |
| Aluminum, Titanium, Steel | 0.04 | | | and 4.5.4 |
| Magnesium | 0.20 | | | |
| Cadmium corrosion test, mg/cm$^2$/day (maximum) | 0.20 | | | ASTM F1111 |
| Copper corrosion rating (maximum) | 1b | | | ASTM D130 and 4.5.5 |
| Effect on unpainted surfaces | No streaks or stains | | | ASTM F485 |
| Hydrogen embrittlement | No failures in less than 150 hours when specimens are loaded to 45 percent of fracture strength and immersed in cleaner | | | ASTM F519 and 4.5.6 |

TABLE II-continued

MIL-PRF-32295A Properties and Test Methods

| PROPERTY | REQUIREMENT | | | TEST METHOD |
|---|---|---|---|---|
| Titanium stress corrosion (examined with 500X magnification) | No cracking | | | ASTM F945 Method A |
| Effect on painted surfaces | No streaks, facing, blisters, or discoloration No softening >1 pencil hardness | | | ASTM F502 |
| Effect on plastics | | | | ASTM F484 |
| Acrylic, type A&C | No crazing | | | |
| Polycarbonate, AMS-P-83310 | No crazing after 2 hours at 2000 psi | | | |
| Effect on polyimide wire | No more insulation cracking than with distilled water and no subsequent dielectric breakdown or leakage | | | 4.5.7 |
| Effect on sealant | No change in Shore A hardness greater than ±5 units | | | 4.5.8 |
| Cleaning efficiency on | Type 1 | Type 1I | Type 1II | 4.5.9 |
| MIL-PRF-83282 soil | ≧85% | ≧95% | ≧85% | |
| Mil-G-21164 soil | ≧60% | ≧70% | ≧60% | |
| Mil-PRF-10924 soil | ≧75% | ≧85% | ≧75% | |

The following is a list of the ASTM standard test used to obtain the data set forth in Tables I and II.

ASTM INTERNATIONAL

| | |
|---|---|
| ASTM D56 | Standard Test Method for Flash Point by Tag Closed Cup Tester (DoD adopted) |
| ASTM D130 | Standard Test Method for Corrosiveness to Copper from Petroleum Products by Copper Strip Test (Dod Adopted) |
| ASTM D891 | Standard Test Methods for Specific Gravity, Apparent, of Liquid Industrial Chemicals (DoD Adopted) |
| ASTM D1296 | Standard Test Method for odor of Volatile Solvents and Diluents (DoD Adopted) |
| ASTM D1353 | Standard Test Method for Nonvolatile Matter in Volatile Solvents for Use in Paint, Varnish, Lacquer, and Related Products (DoD Adopted) |
| ASTM D1613 | Standard Test Method for Acidity in Volatile Solvents and Chemical Intermediates Used in Paint, Varnish, Lacquer, and related products (DoD) Adopted) |
| ASTM D2240 | Standard Test Method for Rubber Property-Durometer Hardness (DoD Adopted) |
| ASTM D2879 | Standard Test Method for Vapor Pressure-Temperature Relationship and Initial Decomposition Temperature of Liquids by Isoteniscope (DoD Adopted) |
| ASTM F483 | Standard Test Method for Total Immersion Corrosion Test for Aircraft Maintenance Chemicals (DoD Adopted) |
| ASTM F484 | Standard Test Method for Stress Crazing of Acrylic Plastics in Contact with Liquid or Semi-liquid Compounds (DoD Adopted) |
| ASTM F485 | Standard Test Method for Effects of Cleaners on Unpainted Aircraft Surfaces |
| ASTM F502 | Standard Test Method for Effects of Cleaning and Chemical Maintenance Materials on Painted Aircraft Surfaces (DoD Adopted) |
| ASTM F519 | Standard Test Method for Mechanical Hydrogen Embrittlement Evaluation of Plating/Coating Processes and Service Environments (DoD Adopted) |
| ASTM F945 | Standard Test Method for Stress-Corrosion of Titanium Alloys by Aircraft Engine Cleaning Materials (DoD Adopted) |
| ASTM F1110 | Standard Test Method for Sandwich Corrosion Test (Dod Adopted) |

-continued

| ASTM INTERNATIONAL | |
|---|---|
| ASTM F1111 | Standard Test Method for Corrosion of Low-Embrittling Cadmium Plate by Aircraft Maintenance Chemicals (DoD Adopted) |

Immersion Corrorion.
The immersion corrosion test was conducted in accordance with ASTM F483 (using the 7 day duration) on test panels constructed on the following materials:

| TEST PANEL | WEIGHT CHANGE ($mg/cm^2/day$) MAX. ALLOWABLE | RESULTS |
|---|---|---|
| Aluminum alloy 2024 (T3 temper), conforming to SAE-AMS-QQ-A-250/4 | 0.04 | 0.01 |
| Aluminum alloy 7075 (T6 temper), conforming to SAE-AMS-QQ-A-250/12 | 0.04 | 0.01 |
| Titanium alloy (6Al-4V), conforming to SAE-AMS4911 | 0.04 | 0.01 |
| Carbon steel (1020), conforming to SAE-AMS5040 | 0.04 | 0.01 |
| Magnesium alloy (AZ31B-H24), conforming to SAE-AMS4377, chrome pickled to SAE-AMS-M-3171, type VI | 0.20 | 0.01 |

While various embodiments of the invention have been disclosed, the specific composition and methods described herein are not intended to limit the scope of the invention.

The invention claimed is:

1. A non-volatile organic composition having low-VOC or non-VOC compounds, a flash point above 140° F., and a vapor pressure of less than seven millimeters of mercury (7 mm Hg.) consisting essentially of about 50 to 70 parts by weight of at least one alkylated cyclicsiloxane having from 5 to 8 repeating siloxane units wherein said alkylated substituents have 1 to 6 carbon atoms, about 20 to 40 parts by weight of at least one alkylated cyclicsiloxane having 3 or 4 repeating siloxane units wherein said alkylated substituents have 1 to 4 carbon atoms and about 5 to 15 parts by weight of at least one glycol alkyl ether wherein said alkyl substituents have 4 to 8 carbon atoms.

2. The composition of claim 1 wherein the alkyl substituent of the glycol ether has at least 4 carbon atoms.

3. The composition of claim 2 wherein the cyclicsiloxane has 5 repeating siloxane units.

4. The composition of claim 3 wherein the cyclicsiloxane has 4 repeating siloxane units.

5. The composition of claim 1 wherein said alkylated substituents that have 1 to 4 carbons are branched or linear carbon atoms.

6. The composition of claim 2 wherein the glycol ether is diethylene glycol monobutyl ether.

7. The composition of claim 1 wherein said alkylated substituents are methyl or ethyl substituents having 1 to 6 carbon atoms.

8. A non-volatile organic composition having low-VOC or non-VOC compounds, a flash point above 140° F., and a vapor pressure of less than seven millimeters of mercury (7 mm Hg.) consisting essentially of about 60 parts by weight of at least one alkylated cyclicsiloxane having 5 repeating siloxane units wherein said alkylated substituent have 1 to 6 carbon atoms, about 30 parts by weight of at least one alkylated cyclicsiloxane having 4 repeating siloxane units wherein said alkylated substituents have 1 to 4 carbon atoms, and about 10 parts by weight of at least one alkylene glycol alkyl ether wherein said alkyl substituent has 4 to 8 carbon atoms.

9. The non-volatile composition of claim 8 wherein said cyclicsiloxane having 5 repeating siloxane units is decamethylcyclicpentasiloxane.

10. The non-volatile composition of claim 8 wherein said cyclicsiloxane having 4 repeating siloxane units is octamethylcyclictetrasiloxane.

11. The non-volatile composition of claim 8 wherein said alkylene glycol alkyl ether is diethylene glycol monobutyl ether.

12. The non-volatile composition of claim 8 wherein the alkylated substituents of 1 to 4 carbon atoms are derived from alkyl compounds that are either the same or different and are branched or linear carbon atoms.

13. A non-volatile organic composition having low-VOC or non-VOC compounds, a flash point above 140° F., and a vapor pressure of less than seven millimeters of mercury (7 mm Hg.) consisting essentially of about 55 to 65 parts by weight of at least one alkylated cyclicsiloxane having from 5 to 8 repeating siloxane units wherein said alkylated substituents have 1 to 6 carbon atoms, about 25 to 35 parts by weight of at least one alkylated cyclicsiloxane having 3 or 4 repeating siloxane units wherein said alkylated substituents have 1 to 4 carbon atoms and about 8 to 12 parts by weight of at least one glycol alkyl ether wherein said alkyl substituents have 4 to 8 carbon atoms.

14. The composition of claim 13 wherein the alkyl substituent of the glycol ether has 4 carbon atoms.

15. The composition of claim 14 wherein the cyclicsiloxane has 5 repeating siloxane units.

16. The composition of claim 14 wherein the cyclicsiloxane has 4 repeating siloxane units.

17. The composition of claim 16 wherein said alkylated substituents having 1 to 4 branched or linear carbon atoms.

18. The composition of claim 14 wherein the glycol ether is diethylene glycol monobutyl ether.

19. The non-volatile composition of claim 13 wherein the alkylated substituents of 1 to 6 carbon atoms are derived from alkyl compounds that are either the same or different and are branched or linear carbon atoms.

20. The non-volatile composition of claim 13 wherein the alkyl substituent has 4 to 8 branched or linear carbon atoms.

* * * * *